United States Patent [19]

Takimoto

[11] Patent Number: 4,631,777

[45] Date of Patent: Dec. 30, 1986

[54] GRAVITY DOOR HINGE

[75] Inventor: Hideaki Takimoto, Tokyo, Japan

[73] Assignee: Takigen Seizou Co. Ltd., Tokyo, Japan

[21] Appl. No.: 689,506

[22] Filed: Jan. 7, 1985

Related U.S. Application Data

[63] Continuation of Ser. No. 475,875, Mar. 16, 1983, abandoned.

[30] Foreign Application Priority Data

Apr. 26, 1982 [JP] Japan ..... 57-59676[U]

[51] Int. Cl.[4] ..... E05F 1/02

[52] U.S. Cl. ..... 16/315; 16/312

[58] Field of Search ..... 16/312, 316, 318, 247, 16/315

[56] References Cited

U.S. PATENT DOCUMENTS

| | | | |
|---|---|---|---|
| 1,942,715 | 1/1934 | Kunzelman | 16/318 |
| 3,083,402 | 4/1963 | Foltz | 16/318 |
| 3,748,688 | 7/1973 | Berkowitz | 16/247 |

FOREIGN PATENT DOCUMENTS

| | | | |
|---|---|---|---|
| 54446 | 12/1889 | Fed. Rep. of Germany | 16/318 |

*Primary Examiner*—Douglas D. Watts
*Attorney, Agent, or Firm*—Martin Smolowitz

[57] ABSTRACT

A gravity door hinge in which a cam is inserted non-rotatably into the lower half of a socket provided in a fixed member, the upper end of an axial rod is inserted non-rotatably into an axial bore hole provided in a rotational member, a cam follower is fitted rotatably around the middle of the axial rod by inserting the axial rod through a central hole bored in the cam follower, the lower half of the axial rod is inserted rotatably into an axial hole formed by hollowing out the center of the cam, the cam follower is fitted rotatably into the upper half of the socket, on top of the cam housed in the lower half of the socket so that an inclined cam surface formed on the lower end of the cam follower comes into close contact with an inclined cam surface formed on the upper end of the cam, and the base of the socket is completely closed. This gravity door hinge is very advantageous inthat any abrasion due to the off-center loads caused by the door opening and closing operations or the adhesion of dust can be effectively prevented, resulting in a prolongation of the life of the inclined cam surface of the cam follower, etc. This gravity door hinge also ensures the smooth operation of the door.

5 Claims, 6 Drawing Figures

GRAVITY DOOR HINGE

This application is a continuation of application Ser. No. 475,875, filed Mar. 16, 1983, now abandoned.

BACKGROUND OF INVENTION

This invention relates to gravity door hinge which can close a door automatically by its own weight.

Several door hinges of the above type have conventionally been proposed such as that disclosed in Japanese Utility Model Publication No. 1420/1951 and Japanese Patent Publication No. 19394/1977.

In the gravity door hinge according to Publication No. 1420/1951, the door hinge includes a fixed member and a rotational member, both members having cylindrical parts. The cylindrical part of the fixed member is provided with an inclined cam surface on its upper end surface, while the cylindrical part of the rotational member is provided with an inclined cam surface corresponding to the above cam surface on its lower end surface. An axial rod is inserted through the cylindrical parts of the fixed and rotational members so that the two inclined cam surfaces abut each other at the middle of the axial rod.

With the thus constructed door hinge, when a door to which the rotational member is secured is opened by pushing or pulling on the side opposite to the secured side, the door is raised by the cooperation of the two inclined cam surfaces. Because the rotational member is not secured to the door at the center of gravity of the door but at a position to one side of the door, a large bending moment is generated by the off-center load of the door, during the rotating and rising motion of the door, around a part more distant from the center of gravity of the door on the inner peripheral surface of the base of the cylindrical part of the fixed member, and around a part closer to the center of gravity of the door on the inclined cam surface of the fixed member. As a consequence, the lower part of the axial rod and the edge of the cam surface, which are in sliding contact with these parts, having a strong external force exerted on them slantwise in the vertical direction. This external force is worse at the edge of the inclined cam surface than at the lower part of the axial rod, so that as the door rising and closing motions are repeated over a long period of time, the edge of the cam surface becomes bent, deformed by pressure, or abraded, resulting in the relatively short service life of the hinge.

In Publication No. 19394/1977, the gravity door hinge of which is of the reversible type and is applicable to either a right hand or a left hand door, the above defect is one of the greatest problems to be overcome.

In this reversible type of gravity door hinge, an inclined cam surface is formed on the inner base of a cylindrical cam inserted into a base socket of the fixed member, and also at the lower end of a cam follower inserted into the rotational member. Because the cam follower is inserted into the cylindrical cam, the bending moment generated by the off-center load occurs around a part more distant from the center of gravity of the door on the inner peripheral surface of the lower part of the cylindrical cam, and also around a part closer to the center of gravity of the door on the inner peripheral surface of the upper part of the cylindrical cam. As a consequence, the lower end of the follower, that is the edge of the inclined cam surface, and the upper end of the cam follower, which are in sliding contact with these parts, have a strong external force exerted on them slantwise in the vertical direction. This external force, similar to that in the hinge of Publication No. 1420/1951, has a relatively large and inconvenient effect on the edge of the inclined cam surface, causing the bending, deformation, or abrasion thereof. Accordingly, it is very difficult to obtain a long-lasting gravity door hinge of this type.

In the door hinge of Publication No. 19394/1977, cam accomodating the cam follower is further provided with a tapered cam surface on the inside of its base, in the center of which a small hole is bored. In addition, the center of the bottom of the socket accomodating the cam is provided with a through hole which is in communication with the small hole in the cam.

This structure proves rather disadvantageous in the following respect. When the door is at its closed position, dust and moisture in the surrounding atmosphere can enter through the through hole in the bottom of the socket into the small hole in the bottom of the cam and attach thereto. When the door is opened, the dust and moisture accumulated in the small hole advances from the small hole into the hollow space in the cam which is formed by the raising of the cam follower, and then sinks onto the cam surface inside the bottom of the cam and at the lower part inside the cam, where they finally accumulate.

This accumulation of dust is an important cause of the abrasion of the cam surfaces of the cam and cam follower and the lower part inside the cam, because the cam follower repeats its rotation and sliding in the vertical direction within the cam every time the door is opened and closed. This abrasion is very inconvenient because it reduces the life of the cam and cam follower, and also the life time of the gravity door hinge itself is reduced. The accumulated dust also works as a resistance against the rotation and vertical motion of the cam follower to prevent the smooth operation thereof.

SUMMARY OF INVENTION

Accordingly, the object of the present invention is to provide a gravity door hinge of the reversible type which is applicable for right hand and left hand doors, within any deformation and abrasion of the edge of the inclined cam surface due to the off-center load caused by opening and closing operations of the door can be effectively prevented, and any abrasion of the cam and cam follower caused by dust entering into the hollow space of the cam can be effectively prevented so as to lengthen the life of these members to a great extent, and further provide a gravity hinge, which is easy and smooth to operate.

The gravity door hinge according to the present invention is constructed as follows. A cam having an inclined cam surface on its upper end is inserted non-rotatably into the lower half of a socket provided in a fixed member, the socket opening upwards. The upper half of an axial rod is inserted non-rotatably into an axial hole provided in a rotational member. The axial rod is also inserted non-rotatably into a central hole bored in a cam follower which has an inclined cam surface at its lower end, so that the cam follower is positioned substantially at the middle of the axial rod. The lower end of the axial rod is fitted rotatably into an axial hole formed by hollowing out the center of the inclined cam surface of the cam. The cam follower attached around the axial rod is inserted into the upper half of the socket on top of the cam housed in the lower half of the socket, so that the inclined cam surfaces of the cam and cam follower are in close contact with each other. The upper and lower ends of the rotational member are provided with recesses for receiving the upper part of the cam follower, which are concentric with the axial hole in the rotational member. The inner bottom surfaces of these receiving recesses are designed to be parallel to each other. The bottom of the socket is completely closed.

BRIEF DESCRIPTION OF DRAWINGS

The present invention will now be described in detail with reference to the accompanying drawings in which the gravity door hinge according to an embodiment of the present invention is illustrated, in which.

DESCRIPTION OF INVENTION

Figure 1:
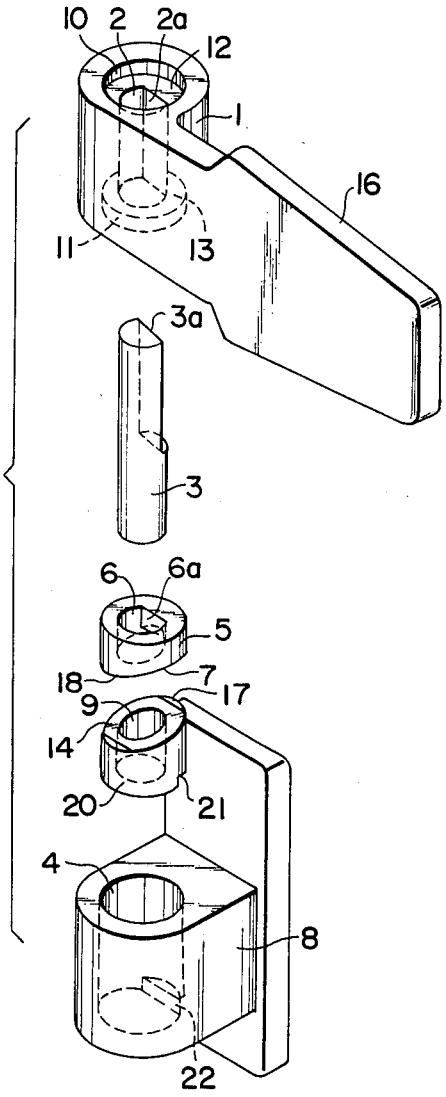
FIG. 1 is an exploded perspective view of the gravity door hinge according to the embodiment of the present invention.

As illustrated in FIGS. 1 to 4, the gravity door hinge has a construction as follows. A cam 20 having an inclined cam surface 14 on its upper end is inserted non-rotatably into the lower half of a socket 4 provided in a fixed member 8, the socket opening upwards. Thye upper half of an axial rod 3 is inserted non-rotatably into an axial hole 2 provided in a rotational member 1. The axial rod 3 is also inserted non-rotatably into a central hole 6 bored in a cam follower 5 which has an inclined cam surface 7 at its lower end, so that the cam follower 5 is positioned substantially at the middle of the axial rod 3. The lower end of the axial rod 3 is fitted rotatably into an axial hole 9 formed by hollowing out the center of the inclined cam surface of the cam 20. The cam follower 5 attached around the axial rod 3 is inserted into the upper half of the socket 4 on top of the cam 20 housed in the lower half of the socket, so that the inclined cam surfaces 7 and 14 of the cam follower 5 and cam 20, respectively, are in close contact with each other. The upper and lower ends of the rotational member 1 are provided with recesses 10, 11 for receiving the upper part of the cam follower 5, which recesses are concentric with the axial hole 2 of the rotational member 1. The inner bottom surfaces of these receiving recesses 10 and 11 are designed to be parallel to each other. The bottom of the socket 4 is completely closed.

In the illustrated embodiment, the axial hole 2 of the rotational member 1 is in the shape of a circle with an arc removed, and the cross section of the axial rod 3 is also of this shape. Where the upper half of the axial rod 3 is inserted into the axial hole 2, a perpendicular side wall 3*a* of the axial rod 3 engages with a perpendicular inner wall 2*a* of the axial hole 2, thereby preventing the rotation of the axial rod 3 with respect to the rotational member 1.

The cam follower 5 is preferably made of a hard plastic of a low coefficient of fricition, and is shaped as a short cylinder, the upper half of the central hole 6 of which is of the same shape as that of the axial hole 2, and the lower half thereof is of a circular shape. A perpendicular inner wall 6*a* of the central hole 6 engages with the perpendicular side wall 3*a* of the axial rod 3 when assembled, so that the cam follower 5 cannot rotate with respect to the axial rod 3. The inclined cam surface 7 at the lower end of the cam follower 5 crosses the central hole 6 obliquely.

The axial hole 9 of the cam 20 is a complete circle and receives the lower half of the axial rod 3 so as to permit a mutual rotation therebetween.

The receiving recesses 10 and 11 provided concentrically with the axial hole 2 on the upper and lower ends of the rotational member 1 have a circular cross section, the inner bottom surfaces 12 and 13 of which form horizontal planes which intersect the axial hole 2 at right angles. The cam follower 5 is inserted into either of the receiving recesses 10 and 11.

The cam 20, of a hard plastic of a low coefficient of friction, is of a cylindrical shape having the same outer diameter as that of the cam follower 5. This cam 20 is inserted into the lower half of the socket 4 so that is rotation relative to the socket is prevented. In more detail, the cam 20 is prevented from rotating by an engagement between a segment-shaped notch 21 at the base end of the cam 20 and a segment-shaped protrusion 22 on the bottom of the socket 4.

Figure 2:
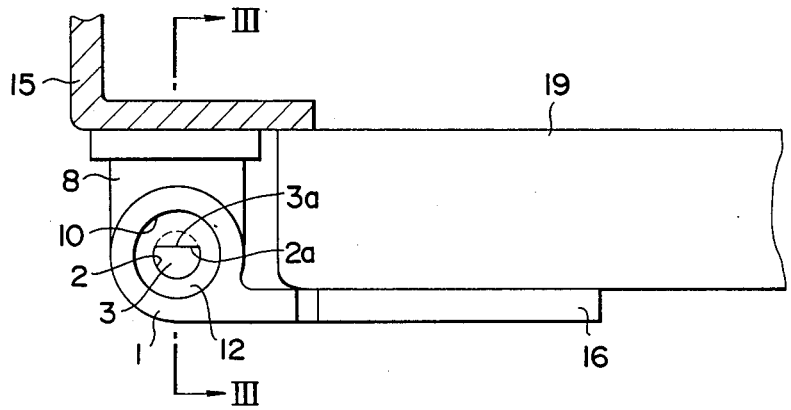
FIG. 2 is a top plan view of the gravity door hinge of FIG. 1 when applied to a left hand door.

In the gravity door hinge applied to a left hand door 19 as illustrated in FIG. 2, the fixed member 8 is secured to the left side frame of the opening of, for example, a refrigerator body 15. Similarly, the rotational member 1 is secured to the front of the left-hand side of a door 19 by an arm-like mounting means 16. The upper part of the cam follower 5 engages with the receiving recess 11 on the lower side of the rotational member 1.

Figure 3:
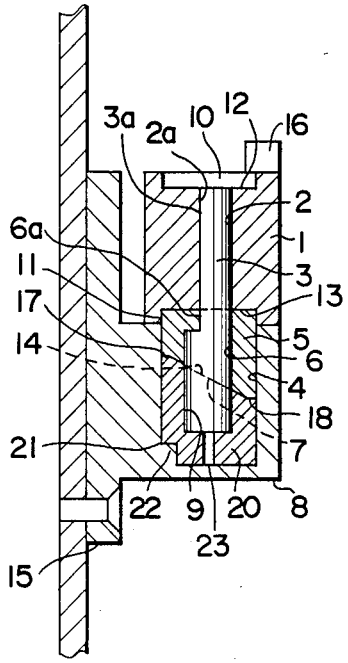
FIG. 3 is a section taken along the line III—III of FIG. 2.
Figure 4:
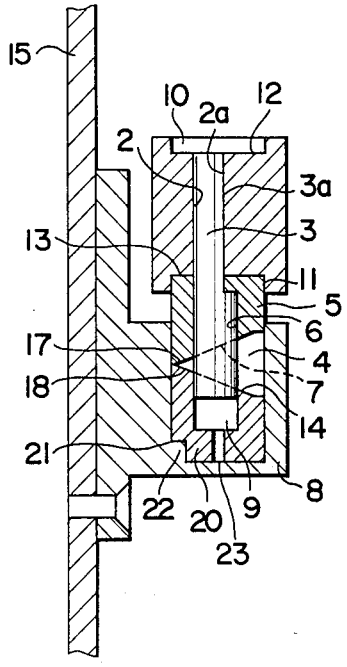
FIG. 4 is a section corrsponding to FIG. 3 when the left hand door is completely open.

When the door 19 is at its completely closed position as shown in FIG. 3, the lower surface of the rotational member 1 and the upper surface of the fixed member 8 are in mutual contact, and the inclined cam surface 14 of the cam 20 and the inclined cam surface 7 of the cam follower 5 are in close contact with each other.

If the door 19 is rotated from this position about the axial rod 3 in the clockwise direction in FIG. 2, the rotational member 1 rises up because the inclined cam surface 7 slides along the inclined cam surface 14. At the final stage where the door 19 is opened at its furthest angle, a horizontal seating surface 18 of the lower part of the cam surface 7 sits on a horizontal seating surface 17 of the upper part of the cam surface 14 as can seen in FIG. 4, and therefore the door 19 is maintained stably at its open position. In this door opening operation, the axial rod 3 fixed to the cam follower 5 slides upward together with the cam follower 5.

If a force is exerted on the door 19 so as to rotate it in the closing direction, the horizontal seating surface 18 drops off the other horizontal seating surface 17. The rotational member 1 then descends slidingly along the inclined cam surface 7 by the weight of the door 19 so that the door finally closes automatically.

Figure 5:
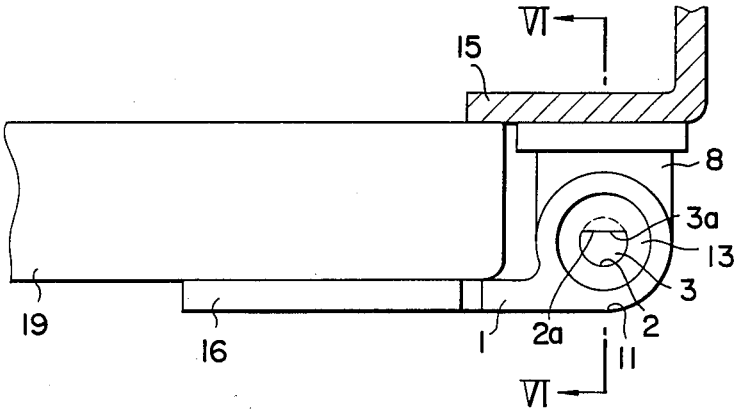
FIG. 5 is a top plan view of the gravity door hinge of FIG. 1 when applied to a right hand door.
Figure 6:
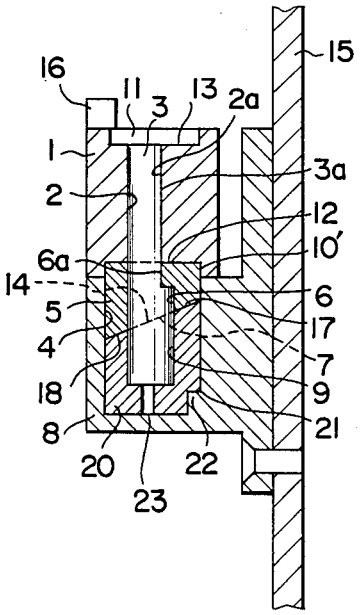
FIG. 6 is a section taken along the line VI—VI of FIG. 5.

When the gravity door hinge of this invention is employed in a right hand door as illustrated in FIG. 5, the fixed member 8 is attached to the right side frame of the opening of the refrigerator body 15 in substantially the same manner as in FIG. 2. The rotational member 1 is attached to the front of the right-hand side of the door 19 by the arm-like mounting means 16 so that it is rotated by 180 degrees in the horizontal plane and turned up-side-down from the position shown in FIG. 2. The cam follower 5 disposed in the same position as in FIG. 2 is inserted into the other receiving recess 10. The inclined cam surface 14 of the cam 20 is brought into contact with the inclined cam surface 7 of the cam follower 5. The raising of the door 19 in its opening motion and the automatic closing motion of the door 19 are carried out in the same manner as that described with respect to the left hand door.

As described in the foregoing, the gravity door hinge according to the present invention has many advantageous characteristics. Firstly, although the inclined cam surface 7 of the cam follower 5 slides along the inclined cam surface 14 of the cam 20 when the door 19 opens or closes, the outer peripheral surface of the cam follower 5 slides around the inner peripheral surface of the socket 4, and also the lower half of the axial rod 3 slides around in the axial hole 9 in the cam 20, the door-closing force due to the weight of the door itself is not reduced excessively by the friction between the cam 20 and the cam follower 5, because these members 20 and 5 are made of a hard plastic with a low coefficient of friction. Thus, a smooth door closing can be obtained.

Even when the cam 20 and cam follower 5 are eventually worn down by repeated door opening and closing operations over a long period of time, it is only necessary to replace these worn members with new ones. Since friction does not act on them, the rotational and fixed members 1 and 8, as well as the other parts, do not need to be replaced. This results in a large saving in the cost of maintaining the gravity door hinge in good working condition.

Secondly, according to the gravity door hinge of the present invention, the cam follower 5 is fitted non-rotatably around the middle of the axial rod 3 and is inserted rotatably into the upper half of the upward-opening socket 4 of the fixed member, the lower half of the axial rod 3 which projects downward from the cam follower 5 is inserted rotatably into the axial hole 9 provided in the center of the cam 20 which is disposed non-rotatably in the lower half of the socket 4, and the inclined cam surface 7 at the lower end of the cam follower 5 is made to come into contact with the inclined cam surface 14 at the upper end of the cam 20. With such a construction, the bending moment caused by the off-center load of the door, which acts during the rising rotation and automatical closing motions of the door, will occur around a part more distant from the center of gravity of the door on the inner peripheral surface of the lower part of the axial hole 9 and also around a part closer to the center of gravity of the door on the inner peripheral surface of the upper part of the socket 4. Accordingly, the upper end of the cam follower 5 and the lower end of the axial rod 3 which are in sliding contact with these parts have an external force exerted on them in the vertical and slantwise direction.

This means that, in the gravity door hinge of the present invention, the lower end of the cam follower 5, that is, the edge of the inclined cam surface 7, is not affected by this external force. As a consequence, the inclined cam surface 7 is completely protected from bending, deformation and abrasion. As a result of this, the edge of the inclined cam surface if made much more durable, and therefore the life of the gravity door hinge is extended.

Thirdly, in the gravity door hinge of the present invention, which is different from that disclosed in Publication No. 19394/1977, no through-hole is provided in the base of the socket 4 communicating with the small hole 23 in the cam 20. This means that in the present hinge no dust can enter through the small hole 23 in the cam 20 into the hollow space between the cam 20 and the socket 4 to adhere to the cam surfaces 7 and 14, etc.

The hinge, thus freed from the wear due to adhered dust, is ensured against an unduly short life of the cam 20 or cam follower 5. In addition, the frictional resistance of the cam follower 5 in the rotational and rising motion of the cam follower 5 is never increased by dust adhering thereto, thereby enabling the smooth operation of the gravity door hinge.

What is claimed is:

1. A gravity door hinge by which a door can be closed automatically by its own weight, comprising:

a cam having an inclined cam surface on the upper end thereof, said cam being inserted nonrotatably into a lower portion of an upward-opening socket which is provided in a fixed member, said cam having a horizontal seating surface at the upper part of the inclined cam surface;

an axial rod having its upper portion inserted nonrotatably into an axial hole provided in a rotational member; and a cam follower which has an inclined cam surface on the lower end thereof, said cam follower being fitted nonrotatably around said axial rod by said axial rod being inserted into a central hole in said cam follower, so that said cam follower is located at a substantially middle position on said axial rod, the lower portion of said axial rod being fitted rotatably into an axial hole formed in the center of said inclined cam surface of said cam, so that said cam follower nonrotatably attached around said axial rod is inserted into and contacts directly the upper portion of said socket on top of said cam housed in the lower portion of said socket, and so that said inclined cam surfaces of said cam and said cam follower are in close contact with each other, said cam follower having a horizontal seating surface at the lower part of the inclined cam surface, and wherein said rotational member is provided on the lower end thereof with a recess sized for receiving the upper part of said cam follower, said recess being formed concentric with said axial hole in said rotational member, said cam follower upper end being inserted into and closely fitted in said lower recess of the rotational member, and said upward-opening socket being formed so that the base thereof is completely closed.

2. A gravity door hinge according to claim 1, wherein said cam is made of a hard plastic material having a low coefficient of friction.

3. A gravity door hinge according to claim 1, wherein said cam follower is made of a hard plastic material having a low coefficient of friction.

4. A gravity door hinge according to claim 1, wherein said rotational member has a recess on its upper end adapted for receiving the upper part of said cam follower, whereby the rotational member can be reversed and said cam follower inserted into either the upper or lower recess for use on either a right hand or left hand door installation.

5. A gravity door hinge by which a door can be closed automatically by its own weight, comprising:

(a) a cam having an inclined cam surface on the upper end thereof, said cam being inserted nonrotatably into the lower half of an upward-opening socket which is provided in a fixed member, said cam being made of a hard plastic material having a low coefficient of friction and having a horizontal seating surface at the upper part of the inclined cam surface;

(b) an axial rod having its upper half inserted nonrotatably into an axial hole provided in a rotational member; and (c) a cam follower which has an inclined cam surface on the lower end thereof, said cam follower being fitted non-rotatably around said axial rod by said axial rod being inserted into a central hole in said cam follower, so that said cam follower is located at a substantially middle position on said axial rod, the lower half of said axial rod being fitted rotatably into an axial hole formed by hollowing out the center of said inclined cam surface of said cam, so that said cam follower nonrotatably attached around said axial rod is inserted into and contacts directly the upper half of said socket on top of said cam housed in the lower half of said socket, and so that said inclined cam surfaces of said cam and said cam follower are in close contact with each other, said cam follower being made of a hard plastic material having a low coefficient of friction and having a horizontal seating surface at the lower part of the inclined cam surface, whereby said horizontal seating surfaces are placed in mutual contact whenever the rotational member is rotated to its farthest angle, so as to maintain the door stably in its open position, and wherein said rotational member is provided on the upper and lower ends thereof with recesses for receiving the upper part of said cam follower, each recess being formed concentric with said axial hole in said rotational member and having an inner base surface which is parallel to that of the other receiving recess, said cam follower upper end being inserted into and closely fitted in said lower recess of the rotational member, and said upward-opening socket being formed so that the base thereof is completely closed.

* * * * *